US006447195B2

(12) United States Patent
Frueh

(10) Patent No.: US 6,447,195 B2
(45) Date of Patent: Sep. 10, 2002

(54) APPARATUS AND PROCESS FOR PROVIDING PASTY OR LIQUID- TO CREAM-LIKE SUBSTANCES

(75) Inventor: Thomas Frueh, Buehler (CH)

(73) Assignee: Dry-Wet System-Dewe AG, Wohlen (CH)

( * ) Notice: Subject to any disclaimer, the term of this patent is extended or adjusted under 35 U.S.C. 154(b) by 0 days.

(21) Appl. No.: 09/778,791

(22) Filed: Feb. 8, 2001

(30) Foreign Application Priority Data

Feb. 10, 2000 (CH) ..... 0268/00

(51) Int. Cl.[7] ..... B05C 11/00
(52) U.S. Cl. ..... 401/266
(58) Field of Search ..... 401/261, 262, 401/265, 266

(56) References Cited

U.S. PATENT DOCUMENTS 4,225,255 A * 9/1980 Braun et al. ..... 401/137

* cited by examiner

*Primary Examiner*—Gregory Huson
*Assistant Examiner*—Peter deVore
(74) *Attorney, Agent, or Firm*—Burns, Doane, Swecker & Mathis, LLP

(57) ABSTRACT

An apparatus for providing a pasty or liquid- to cream-like substance comprises a container, in which a relatively large supply of the substance is stored, and a closure and dispensing element, which closes a delivery opening of the container. On the one hand, the closure and dispensing element is used for retaining the substance stored in the container, and on the other hand for dispensing a small amount of this substance upon contact of the closure and dispensing element with a surface to be wetted. The closure and dispensing element is designed to be planar and is equipped with openings arranged in a grid-like manner. The openings are designed in such a way that, on the one hand, they hold back a pasty or liquid- to cream-like substance arranged in the interior of the container against the pressure exerted by the substance, in the position of use of the apparatus and, on the other hand, upon contact with the outer surface of the closure and dispensing apparatus with a surface to be wetted, they dispense a small amount of the pasty or liquid- to cream-like substance in a controlled manner.

18 Claims, 2 Drawing Sheets

APPARATUS AND PROCESS FOR PROVIDING PASTY OR LIQUID- TO CREAM-LIKE SUBSTANCES

BACKGROUND OF THE INVENTION

1. Field of the Invention

The invention relates generally to the providing of pasty or liquid- to cream-like substances.

2. Background Information

Dispensers for providing washing and skin care lotions, creams, and similar substances are often used in the fields of hygiene and cosmetics. Such dispensers have a container, in which a relatively large amount of the substance is stored. Dispensing of a small amount of the substance takes place through a delivery opening, which is connected with a pump mechanism, for example. In simpler versions of such dispensers the substance is dispensed through the delivery opening by compressing the container.

Dispensers are also known where the delivery opening is closed by means of a rotatably seated spherical closure element, for example. In their operating position, such dispensers are seated with the delivery opening pointing down. Here, the size and fitting of the spherical element in the delivery opening is selected in such a way that the substance cannot run out unintentionally. Operation of the dispenser takes place by touching the closure element, wherein a section of the surface of the closure element, which is moistened by the substance, comes into contact with the hand of the user, or a cloth, a sheet of paper or the like, by being rotated. A small amount of the pasty or liquid- to cream-like substances placed into the container can be dispensed in this manner.

The known dispensers for pasty or liquid- to cream-like substances mostly have a relatively complicated, and therefore expensive structure. Spherical closure elements must be manufactured extremely accurately and fitted, so that sealing is assured. When being touched, for example by a hand or by a flat article, there mostly is only an essentially linear contact. In fact, the spherical closure element could be replaced by one or several roller-shaped elements for achieving a more extensive contact. However, roller-shaped closure elements generally pose larger sealing problems than spherical ones and therefore must be fitted particularly exactly into holders in the delivery opening. The amount of substance which can be dispensed also depends to a large degree on the ability of the surface of the closure element to become wet. Therefore the latter must be manufactured particularly exactly, and damage to its surface must be prevented as much as possible. Often the closure element cannot be simply rotated, because of which the dispensing of the pasty or liquid- to cream-like substances is hampered. Simple dispensers, where the substance is dispensed by compressing the container, are very inexact regarding the amount of substance being dispensed, and are impractical for wetting articles with more extensive areas, such as a sheet of paper or a cloth.

SUMMARY OF THE INVENTION

It is the object of the present invention to overcome these disadvantages of the dispensers for pasty or liquid- to cream-like substances of the prior art. A dispenser in accordance with the species is to be simplified in regard to its construction. In connection with this, the dependability of the seal in the operating position is to be assured, and the dispensed amount of the pasty or liquid- to cream-like substances is to be controllable in a relatively simple way.

The attainment of these objects consists of an apparatus and a method for providing pasty or liquid- to cream-like substances having the apparatus or method characteristics recited in the characterizing portions of the respective independent patent claims of the respective categories. Advantageous embodiment variations and/or further developments of the invention are the subject of the dependent apparatus or method claims, as well as of the use claims.

An apparatus for providing a pasty or liquid- to cream-like substance comprises a container, in which a relatively large supply of the substance is stored, and a closure and dispensing element, which closes a delivery opening of the container. On the one hand, the closure and dispensing element is used for keeping back the substance stored in the container, and on the other hand for dispensing a small amount of this substance when the closure and dispensing element comes into contact with a surface to be wetted. In accordance with the invention, the closure and dispensing element is designed to be planar and is provided with openings arranged in a grid-like manner. On the one hand, the openings are designed in such a way that in the position of use of the apparatus they keep back a pasty or liquid- to cream-like substance arranged inside the container against the pressure exerted by the substance, and on the other hand dispense a small amount of the pasty or liquid- to cream-like substance in a controlled manner when the outside of the closure and dispensing element touches a surface to be wetted.

The provision of a closure and dispensing element, which is designed to be planar and has openings arranged in a grid-like manner noticeably simplifies the construction of the apparatus in accordance with the invention. In place of spherical or possibly roller-shaped closure elements which, for reasons of tightness, must be manufactured highly precisely and fitted into receivers in the delivery opening, a simple screen structure is used. The openings in the closure and dispensing element, which is designed to be planar, are dimensioned in such a way that the retention capability is sufficient to hold back the pasty or liquid- to cream-like substance arranged inside the container against the exerted pressure. The substance cannot leave through the openings in an uncontrolled manner. Instead, as a result of the dimensions of the openings there is only a formation of drops, wherein the drops protrude over the outer surface of the closure and dispensing surface. The substance is dispensed only upon contact with a surface to be wetted, for example the surface of a sheet of paper, or a fabric or a hand. Because of the size of the openings, this does not take place arbitrarily, but controlled, preferably by drops. When dispensing the pasty or liquid- to cream-like substance, the closure and dispensing element designed in accordance with the invention is at rest in respect to the delivery opening. Therefore the simple design of the apparatus in accordance with the invention avoids sealing problems caused by rotatably seated closure elements. The apparatus in accordance with the invention can also be produced more simply and cost-effectively because of the simplified construction.

The closure and dispensing element, which is designed to be planar, can be embodied to be convex or concave. However, it can be particularly simply produced as a flat screen plate. For example, it can be made as a small flat plate of metal or plastic.

In an advantageous embodiment variation of the invention, the openings are designed to be funnel-shaped. To this end, they have a clear cross section at the outer surface of the closure and dispensing element, which is smaller than in an area closer to the container interior. Because of this, the opening can be designed in a way which hampers the flow of the substance as little as possible. The drop formation then only takes place in the area of the openings with the smallest cross section. By means of the cross section of the openings, which tapers toward the outer surface, it is also assured that the formed drops protrude sufficiently far beyond the outer surface of the closure and dispensing element, which is designed to be planar, and are stripped off upon contact with the surface to be wetted.

The dimensioning of the opening must take into consideration the conditions of compatibility set by the liquid to be provided, so that the two goals, the retention capability of the screen structure on the one hand, and the controlled dispensing onto a surface which is in contact with the outer surface of the screen structure, for example a sheet of paper, a web of fabric or the hand, can be achieved on the other hand. Essential factors which are of importance here are the surface tension $\alpha(T)$ and the density $\rho(T)$ of the pasty or liquid- to cream-like substance, the height h of the substance inside the container, the respective temperature T of the substance, the pressure $p_1$ in the container, or the atmospheric pressure $p_o$, and the acceleration due to gravity g.

The openings can have an elongated, round, or also a regular polygonal clear cross section. The smaller dimension of the clear cross section of the openings at the outer surface of the closure and dispensing element is particularly decisive for the drop formation. Taking into consideration the previously mentioned conditions of compatibility, its is advantageously selected in accordance with the equation:

$$d \leqq 4\alpha(T)/[h^*\rho(T)^*g+p_1-p_o].$$

Because the closure and dispensing element, which is designed to be planar, has a thickness which is less than one-half of the smaller dimension of the clear cross section of the openings on its outer surface, it is assured that the drops formed at the openings protrude sufficiently far past the outer surface of the closure and dispensing surface, so that they can be dispensed in a controlled manner when in contact with a surface to be wetted.

Particularly good relations between the retention capability on the one hand, and the ease of dispensing on the other when the outer surface is in contact with a surface to be wetted, can be achieved with a closure and dispensing element, which is designed to be planar and has a honeycomb-like structure, where each opening at the outer surface has the contours of a preferably regular hexagon.

In a variation of the invention the container is embodied to be closed, except for the delivery opening, in order to prevent miscellaneous contamination of the pasty or liquid- to cream-like substance stored in the container.

In order to be able to use the apparatus again after it has been completely emptied, the closure and dispensing element, which is designed to be planar, is provided on a cover element, which can be removably placed on a collar surrounding the outlet opening of the container. Embodied in this way, the container can be used again after the cover element has been removed.

It can also be advantageous to hold the closure and dispensing element exchangeably in the cover element. This offers the option of employing the closure and dispensing elements in connection with specific substances. The production of the cover element takes place completely separately from the production of the closure and dispensing elements. The two elements are only joined in a final assembly process, which can already take place with regard to the substance to be stored in the container. The cover element and the closure and dispensing element can be made of different materials. For example, the cover element can be a plastic part, and the closure and dispensing element a metal part.

It is usually also advantageous if the areas of the outer surface of the closure and dispensing element remaining between the openings have a hydrophobic surface. By means of this step it is assured that the drop formation takes place only at the openings, and no running of the formed drops occurs.

In a further development of the invention that closure and dispensing element can have two screen plates, which are preferably designed to be planar. The two screen plates are arranged rotatable in respect to each other so that the clear cross section of the openings is changed. This offers a simple opportunity to adapt the clear cross section of the openings to the conditions of compatibility set by the pasty or liquid- to cream-like substance to be provided. One of the two screen plates is then arranged fixed in place in respect to the delivery opening. The second screen plate, which is rotatable relative to the first one, can also, for example, be used as a separate closure element in order to compartmentalize the contents of the container if required, or to provide a drip protection. The relative rotation of the two screen plates in respect to each other can take place manually or also automatically in further embodiment variations of the invention.

The method in accordance with the invention for providing a pasty or liquid- to cream-like substance, which is stored in a container and can be applied to a surface by contact of the surface to be wetted with a closure and dispensing element which closes the delivery opening of the container, is distinguished in that, in the position of use of the container, the pasty or liquid- to cream-like substance is located above a closure and dispensing element, which is embodied to be planar, preferably plate-shaped, and is provided with openings arranged in a manner of a grid. The opening are designed in such a way that they hold back the pasty or liquid- to cream-like substance against the pressure exerted by the substance and release a small amount of the substance to the surface in a controlled manner only when there is contact between the surface to be wetted and the outer surface of the closure and dispensing element. Because of the planar design of the closure and dispensing element, contact with the surface to be wetted is also planar and not only along lines, such as is the case with spherical closure elements. Because of this a relatively large amount of the substance to be provided is dispensed to the surface of, for example, a sheet of paper, a textile web or a hand. Dispensing essentially takes place at a controlled rate of dispensing, since only the droplets which protrude from the openings are brushed off upon contact.

Dispensing the pasty or liquid- to cream-like substance in this case is usefully performed by a lateral relative movement between the outer surface of the planar closure and dispensing element and the surface to be wetted.

For filling the container, the planar closure and dispensing element is removed from the delivery opening and the substance is poured through the delivery opening into the container. Because of this method it is possible to produce the container with only one opening, the delivery opening. Additional fill openings with covers and the like can be omitted, which has an advantageous effect on the manufacturing process and the manufacturing costs.

In a variation of the invention, wherein the closure and dispensing element is constituted by two screen plates, the two screen plates are rotated in respect to each other for adapting the opening cross section of the opening to the pasty ro liquid- to cream- like substance to be provided.

The claimed invention is particularly distinguished by the use of a planar screen structure as the closure and dispensing element for the delivery opening of a container for holding back a pasty or liquid- to cream-like substance, and for the controlled dispensing of the substance when contacting an outer surface of the screen structure with a surface to be wetted.

In this case the dimensioning of the openings is provided in such a way, that its smaller size is in accordance with the equation:

$$d \leqq 4\alpha(T)/[h^*\rho(T)^*g+p_1-p_o],$$

wherein $\alpha(T)$ identifies the surface tension and $\rho(T)$ the density of the pasty or liquid- to cream-like substance, h stands for the height of the substance inside the container, T identifies the respective temperature of the substance, $p_1$ or $p_o$ identify the pressure in the container, or the atmospheric pressure, and g stands for the acceleration due to gravity.

The fields of hygiene and/or cosmetics are to be mentioned as applications for an apparatus equipped in accordance with the invention for dispensing pasty or liquid- to cream-like substances to a flat substrate, for example a piece of paper or a textile web, or also directly to a hand. Planar coating, impregnating and adhesive applications are also considered to be areas of use of the apparatus in accordance with the invention. In case of substances which harden by contact with the air it is possible to take precautions on the apparatus for isolating the adhesive from the ambient air during storage. For example, an additional cover can be provided, which is placed over the closure and dispensing element.

BRIEF DESCRIPTION OF THE DRAWINGS

Other objects and advantages of the present invention will become more apparent from the following detailed description of preferred embodiments, when read in conjunction with the accompanying drawings wherein like elements have been represented by like reference numerals and wherein.

DETAILED DESCRIPTION OF THE INVENTION

Figure 1:
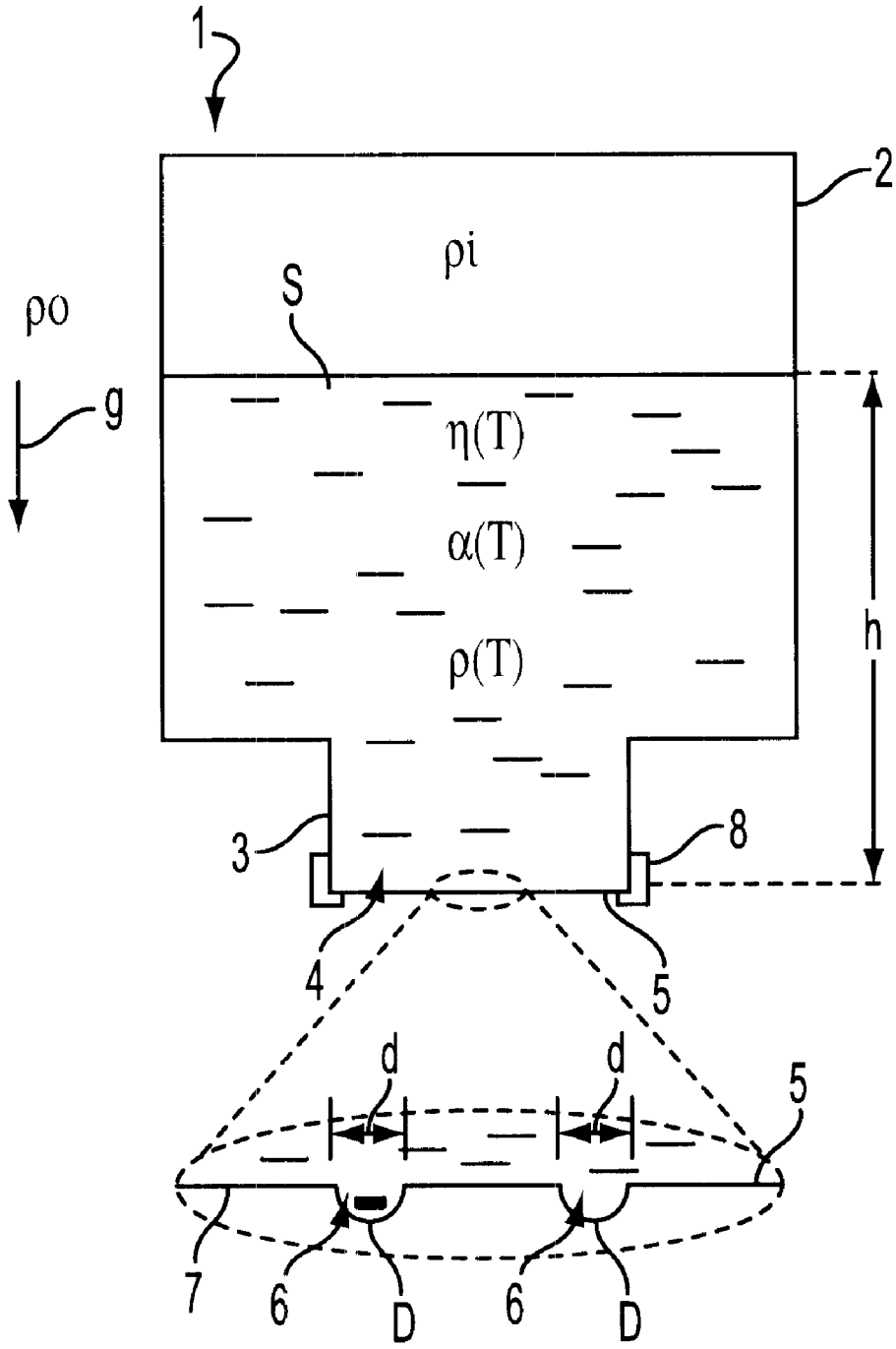
FIG. 1 is a basic representation of the apparatus.

The apparatus for providing a pasty or liquid- to cream-like substance as a whole has been provided with the reference numeral 1 in the basic representation in FIG. 1. It comprises a container 2 with a tapering collar 3, which extends around a delivery opening 4 for a pasty or liquid- to cream-like substance S stored in the container 2. The delivery opening 4 is closed by means of a closure and dispensing element 5, which is embodied to be planar and is provided with openings 6, which are distributed over its surface in a grid-like manner. As a whole, the closure and dispensing element 5 is comparable to a screen plate.

The planar closure and dispensing element 5 can be embodied to be convexly or concavely curved or, as represented, flat. It is usefully inserted into a cover element, which is indicated by the reference numeral 8 in FIG. 1. In accordance with the basic representation of the exemplary embodiment, the cover element 8 can be releasably pushed or screwed on the collar 3 of the container 2. The closure and dispensing element 5 can be exchangeably seated in the cover element 8. But it can also be formed integrally with the cover element 8. Variations of the apparatus 1 are also possible, wherein the closure and dispensing element 5 is embodied integrally with the collar 3. In further embodiment variations an additional cover can be provided which can be placed over the closure and dispensing element 5 when required in order to close the container 2 completely.

FIG. 1 shows the apparatus 1 in the position of use with the openings 6 oriented downward. The openings 6 are dimensioned in such a way that the substance S stored inside the container 1 is held back. Drops D of the substance S protrude through the openings 6, which are dispensed in a controlled manner only in case of contact of the outer surface 7 of the closure and dispensing element 5 with the surface of a planar substrate to be wetted. The characteristic values which are essential for dimensioning the opening 6 in the closure and dispensing element are indicated in FIG. 1. These are:

- the viscosity or tenacity of the pasty or liquid- to cream-like substance S, which is identified by $\eta(T)$ and is a function of the temperature,
- the surface tension $\alpha(T)$ of the substance S, which is also a function of the temperature, as indicated by the parameter T shown in parentheses and standing for the temperature of the substance S,
- the temperature-dependent density $\rho(T)$ of the substance S,
- the level of the substance S inside the container 2 and indicated by h,
- the pressure $p_1$ in the interior of the container,
- the atmospheric pressure $p_o$,
- the acceleration due to gravity g, and
- the smaller dimension d of the clear cross section of the openings. A circular cross sections is assumed for reasons of simplification. In this case d identifies the diameter of the opening circle.

The diameter d of the openings at the outer surface 7 of the closure and dispensing element 5 is of importance for the functioning of the apparatus in accordance with the invention. If the openings 6 are too small, the substance S is held back very well, but it also does not exit in the form of drops D through the openings 6, since its gets stuck, so to speak. On the other hand, with openings which are dimensioned too large, there is the danger that the substance S runs out.

The pressure at the boundary layer between the substance S and the ambient air is of importance for forming the drops D. At equilibrium the pressure at the boundary layer must equal zero. The pressure which is decisive for drop formation is composed inside the container 2 from the pressure h * $\rho(T)$ * g of the substance S at a level h inside the container 2, and the air enclosed in the container 2, which exerts a pressure $p_1$, and is independent of the atmospheric pressure $p_o$. Outside of the container 2, the atmospheric pressure $p_o$ acts on the boundary layer of the drop D. If the two pressures are not of equal size, a difference $\Delta p$ is created, in connection with which the following applies:

$$\Delta p = h^*\rho(T)^*g+p_i-p_o. \quad (1)$$

The pasty or liquid- to cream-like substance S counteracts this pressure difference $\Delta p$ by means of its surface tension $\alpha(T)$, namely in the form:

$$\Delta p=2^* \alpha(T)/r. \quad (2)$$

In this equation, r stands for the radius of a drop D.

Figure 2:
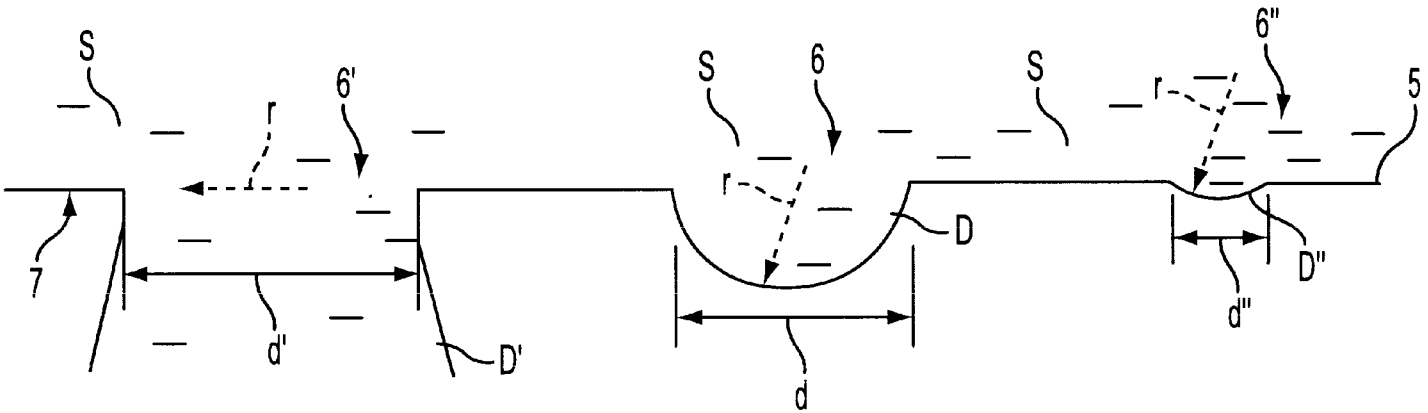
FIG. 2 is a basic representation of a section of the closure and dispensing element for clarifying the size of the openings.

The following connection exists between the radius r of the drop D and the diameter d of the opening, which is also indicated in the schematic representation in FIG. 2. With an opening diameter d which is greater than twice the radius r, i.e., d>2* r, the surface tension cannot compensate for the pressure difference Δp, and the substance S flows out. This is indicated in FIG. 2 by means of the example of the left opening 6' in the closure and dispensing element 5 having the diameter d'. The substance flowing out of the opening 6' is identified by D'. If the opening diameter d is exactly identical to double the radius r of the drop D, i.e. d=2* r, the substance S can just be held back. This is illustrated in FIG. 2 by means of the example of the central opening 6. The diameter d of the opening can also be selected to be less than 2* r. However, the smaller the diameter d, the less the drops D" protrude out of the opening 6" past the surface of the closure and dispensing element 5. This case is represented in FIG. 2 by means of the example of the right opening 6" with the diameter d".

By combining the two equations (1) and (2) shown above, and taking into consideration the described connections between the radius r of the drops D and the diameter d of the openings 6, the following equation results for the diameter of the openings:

$$d \leqq 2^* r=4\alpha(T)/[h^* \rho(T)^*g+p_1-p_o]. \quad (3)$$

By means of this equation a direct connection is established between the values α(T) and ρ(T), the surface tension and the density of the substance S to be provided, and the values d and H, which relate to the construction of the apparatus 1, the diameter of the openings 6 in the closure and dispensing element 5 and the level of the substance S inside the container 2, which permits the goal oriented dimensioning of the apparatus 1, and in particular of the openings 6.

When the outer surface 7 is brought into contact with a surface to be wetted of a flat substrate, for example a piece of paper, a small amount of the substance flows out under controlled conditions and wets the paper. This is a result of the adhesive forces $F_A$ occurring between the substance and the sheet of paper. Frictional forces $F_R$ oppose the adhesive forces $F_A$. While the adhesive forces $F_A$ are a function of the nature of the substance S and of the sheet of paper, the frictional forces are a function of the viscosity η(T) of the substance, the linear dimensions of the object which is being passed by the substance S, therefore from the diameter d of the openings 6, and from the flow speed v of the substance. This leads to the proportional relationship:

$$F_R\ \eta(T)^*d^*v. \quad (4)$$

By means of the simplification that, at the time of the contact of the two surfaces, the surface tension of the substance S is negligible, now only the adhesive forces $F_A$ and the frictional forces $F_R$ appear. Furthermore, for the following estimation the state is considered in equilibrium, i.e. a state wherein the substance S flows at a constant speed v. Under these conditions it is also possible to express the pressure difference as:

$$\Delta p=[F_R-F_A]/A. \quad (5)$$

In this relationship, A identifies the contact surface between the substance S and the sheet of paper or, expressed differently, the sum of the clear cross sections of the openings 6 in the closure and dispensing element 5. If this relationship is combined with the equation (1), the following results:

$$[F_R-F_A]/A=h^*\rho(T)^*g+p_1-p_o. \quad (6)$$

Taking into consideration the proportional relationship in the equation (4) above, the following results:

$$[\eta(T)^*d^*v-F_A]/A\ h^*\rho(T)\ ^*g+p_1-p_o. \quad (7)$$

By means of transformation, the following results for the flow speed of the substance S:

$$v\ [A/\eta(T)]^*d^*[h^*\rho(T)^*g+p_1-p_o]=F_A/\eta(T)^*d]. \quad (8)$$

The amount of outflow Φ of the substance S, delivered from the container 2 when the surfaces are in contact, is of interest, to which the following applies:

$$\Phi=v^*\rho(T)^*A. \quad (9)$$

With this relationship, the following expression is obtained for the amount of outflow Φ:

$$\Phi\ [\rho(T)^*A^2/\eta(T)]^*d^*[h^*\rho(T)^*g+p_i-p_o]+F_A{}^*\rho(T)^*A/[\eta(T)^*d]. \quad (10)$$

The contact surface A can be expressed by means of the relationship $A=d^2*\pi/4$. Since in the present estimation there is only a proportionality consideration, the constant factor π/4 can be omitted, and A $d^2$ can be written instead. Thus, for the amount of outflow Φ the following applies in the end:

$$\Phi\ [\rho(T)^*d^3/\eta(T)]^*d^*[h^*\rho(T)^*g+p_i-p_o]+F_A{}^*\rho(T)^*d/\eta(T). \quad (11)$$

Upon contact of the outer surface 7 of the closure and dispensing element 5 with the surface of a planar substrate, the amount of outflow Φ of the substance is therefore the greater, the greater the density ρ(t) of the substance S is, the greater the diameter d of the openings 6 is, the higher the level h of the substance S inside the container 2 is, the higher the pressure $p_1$ inside the container 2 is, the greater the adhesive forces $F_A$ are.

In contrast thereto, the amount of outflow Φ is less the greater the viscosity η(T) of the substance S is, the higher the atmospheric pressure $p_o$ is.

The approximately derived relationship represents the functional interrelationships of the values affecting the total system of the apparatus in accordance with the invention, and allows an optimized construction of the apparatus.

Figure 3:
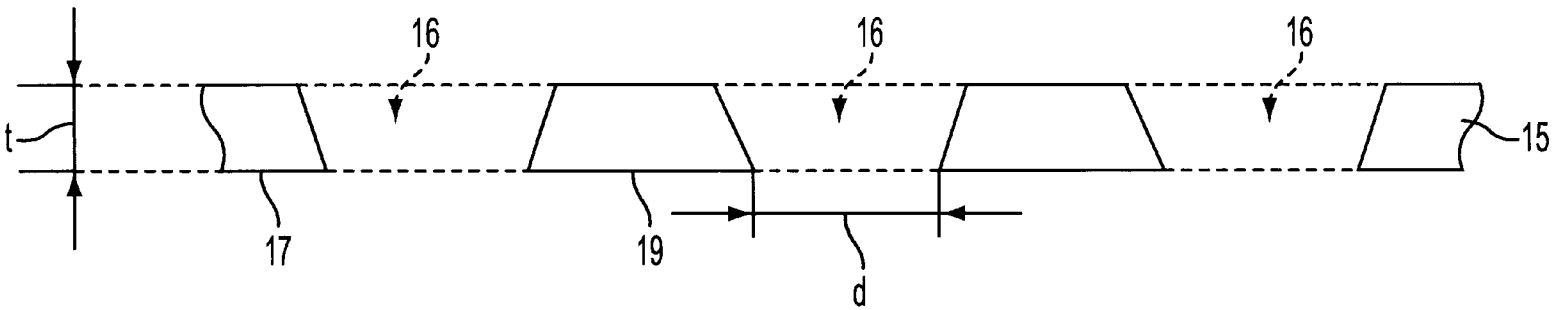
FIG. 3 is a section of a variation of the closure and dispensing element.

FIG. 3 shows a section of a variation of the closure and dispensing element, which as a whole is identified by the reference numeral 15. The openings are identified by 16. It can be seen from the representation that the openings 16 have a lesser clear cross section at the outer surface 17 of the closure and dispensing element 15 than in an area located further inside, in the case represented the inner surface of the closure and dispensing element 15 pointing into the interior of the container. The thickness t of the closure and dispensing element 15 is less than half the opening diameter d. Also indicated is the area, identified by 19, of the outer surface of the closure and dispensing element 15 between the openings 16, which is advantageously designed to be hydrophobic, for example coated.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. An apparatus for providing a liquid or pasty substance, the apparatus comprising:

a container, in which a relatively large supply of the substance is stored; and a closure and dispensing element, which closes a delivery opening of the container, wherein the closure and dispensing element is designed to be planar and is provided with openings which are designed to keep back a pasty or liquid- to cream-like substance arranged inside the container against a pressure exerted by the substance, and to dispense a small amount of the pasty or liquid- to cream-like substance in a controlled manner when an outer surface of the closure and dispensing element touches a surface to be wetted, said closure and dispensing element having the thickness that is less than half the clear cross section of the openings on the outer surface.

2. The apparatus in accordance with claim 1, wherein the planar designed closure and dispensing element is a flat screen plate.

3. The apparatus in accordance with claim 1, wherein the openings are designed to be funnel-shaped, and wherein each opening has a smaller clear cross section on the outer surface than in an area of the closure and dispensing element which is closer to an interior of the container.

4. The apparatus in accordance with claim 1, wherein the openings at the outer surface of the closure and dispensing element have a clear cross section, whose smaller dimension has been selected in accordance with the equation:

$$d \leqq 4\alpha(T)/[h^*\rho(T)^*g+p_i-p_o],$$

wherein $\alpha(T)$ identifies the surface tension and $\rho(T)$ identifies the density of the pasty or liquid- to cream-like substance, h stands for the height of the substance inside the container, T identifies the respective temperature of the substance, $p_1$ or $p_o$ identify the pressure in the container, or the atmospheric pressure, and g stands for the acceleration due to gravity.

5. The apparatus in accordance with claim 4, wherein the closure and dispensing element, which is designed to be planar, has a thickness which is less than half the smaller size of the clear cross section of the openings on its outer surface.

6. The apparatus in accordance with claim 1, wherein the closure and dispensing element has a honeycomb-like structure, and wherein each opening on its exterior surface has the contour of a preferably regular hexagon.

7. The apparatus in accordance with claim 1, wherein the container is designed to be closed, with the exception of the delivery opening.

8. The apparatus in accordance with claim 1, wherein the closure and dispensing element, which is designed to be planar, is provided on a cover element, which can be releasably placed or screwed to a collar surrounding the delivery opening of the container.

9. The apparatus in accordance with claim 8, wherein the closure and dispensing element is maintained in an exchangeable manner in the cover element.

10. The apparatus in accordance with claim 1, wherein the areas remaining between the openings of the outer surface of the closure and dispensing element have a hydrophobic surface.

11. The apparatus in accordance with claim 1, wherein the closure and dispensing element comprises two preferably planar designed screen plates, which are arranged rotatable in respect to each other, so that the clear cross section of the openings.

12. A method for providing a pasty or liquid-to cream-like substance, comprising the steps of:

storing the substance in a container, the container comprising a delivery opening;

closing the delivery opening with a closure and dispensing element, the closure and dispensing element being planar and comprising openings, wherein the openings have clear cross sections of predetermined sizes and the closure and dispensing element being designed with a thickness that is less than half the smaller size of the clear cross sections;

locating the substance above the closure and dispensing element;

holding back with the openings the substance against the pressure exerted by the substance, while performing drops at the openings and protruding sufficiently far past the outer surface of the closure and dispensing element; and releasing with the openings a small amount of the substance to a surface to be wetted in a controlled manner only when there is contact between the surface to be wetted and the outer surface of the closure and dispensing element.

13. The method in accordance with claim 12, wherein the step of releasing occurs by means of a lateral relative movement between an outer surface of the closure and dispensing element and the surface.

14. The method in accordance with claim 12, wherein the step of storing further comprises the step of filling the container with the substance through the delivery opening.

15. The method in accordance with claim 12, wherein the closure and dispensing element is constituted by two screen plates, and the clear cross section of the openings is adapted to the substance to be provided by the relative rotation of the two screen plates in respect to each other.

16. The apparatus in accordance with claim 1, wherein the openings are arranged in a grid formation.

17. The method in accordance with claim 12, wherein the closure and dispensing element is plate-shaped.

18. The method in accordance with claim 12, wherein the openings are arranged in a grid formation.

* * * * *